US011661150B1

(12) United States Patent
Stewart

(10) Patent No.: US 11,661,150 B1
(45) Date of Patent: May 30, 2023

(54) TOWABLE VEHICLE WINDSHIELD COVER

(71) Applicant: Battery Doctors & Mild 2 Wild Motorsports, Mandan, ND (US)

(72) Inventor: Jake Stewart, Mandan, ND (US)

(73) Assignee: Battery Doctors & Mild 2 Wild Motorsports, Mandan, ND (US)

( * ) Notice: Subject to any disclaimer, the term of this patent is extended or adjusted under 35 U.S.C. 154(b) by 113 days.

(21) Appl. No.: 17/236,140

(22) Filed: Apr. 21, 2021

Related U.S. Application Data

(60) Provisional application No. 63/066,554, filed on Aug. 17, 2020.

(51) Int. Cl.
*B63B 17/02* (2006.01)
*B63B 17/00* (2006.01)

(52) U.S. Cl.
CPC ..... *B63B 17/02* (2013.01); *B63B 2017/0045* (2013.01)

(58) Field of Classification Search
CPC . B63B 17/00; B63B 17/02; B63B 2017/0045; B60J 1/00; B60J 3/00; B60J 11/00; B60J 11/08
USPC ..... 114/361
See application file for complete search history.

(56) References Cited

U.S. PATENT DOCUMENTS 4,109,957 A 8/1978 Polizzi et al.
4,181,350 A 1/1980 Eichstaedt
4,449,747 A * 5/1984 Morgan ..... B60J 1/2011 156/212
D293,428 S * 12/1987 Watts ..... D12/191
4,726,406 A * 2/1988 Weatherspoon ..... B60J 11/08 296/136.03
5,037,156 A 8/1991 Lundberg
5,356,193 A 10/1994 Palmer, II et al.
6,015,180 A 1/2000 Beuerle
6,155,329 A * 12/2000 Hwang ..... B60J 1/2091 160/370.21
D443,572 S 6/2001 Freeman
7,219,616 B2 * 5/2007 Pritchett ..... B63B 17/02 114/361

FOREIGN PATENT DOCUMENTS

CN 202573762 U * 12/2012 ..... B60J 11/04
CN 206217611 U 6/2017
FR 2890339 A1 3/2007
FR 2932420 B1 7/2010
WO WO 2017/7121913 A1 7/2017

* cited by examiner

*Primary Examiner* — Lars A Olson
(74) *Attorney, Agent, or Firm* — Thorpe North & Western, LLP

(57) ABSTRACT

A windshield cover and method for protecting a windshield of a towed vehicle, such as a boat, can be removably secured over the windshield when being pulled on a trailer. The cover matches the size and shape of the windshield and is flexible to conform to a curvature of the windshield. The cover has a soft, cushion layer and a waterproof and oil-resistant and non-absorbent material. The cover can have bifurcated panels with a partition corresponding to a pass-through of a boat windshield.

19 Claims, 5 Drawing Sheets

TOWABLE VEHICLE WINDSHIELD COVER

PRIORITY CLAIM

Priority is claimed to U.S. Provisional Patent Application Ser. No. 63/066,554, filed Aug. 17, 2020, which is hereby incorporated herein by reference.

BACKGROUND

Towable vehicles, such as boats, watercraft, UTVs, tractors, and heavy equipment, are frequently pulled on a trailer behind a truck. Road debris and rocks can be kicked-up by the wheels of the truck and can strike the windshield of the towed vehicle, causing damage.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
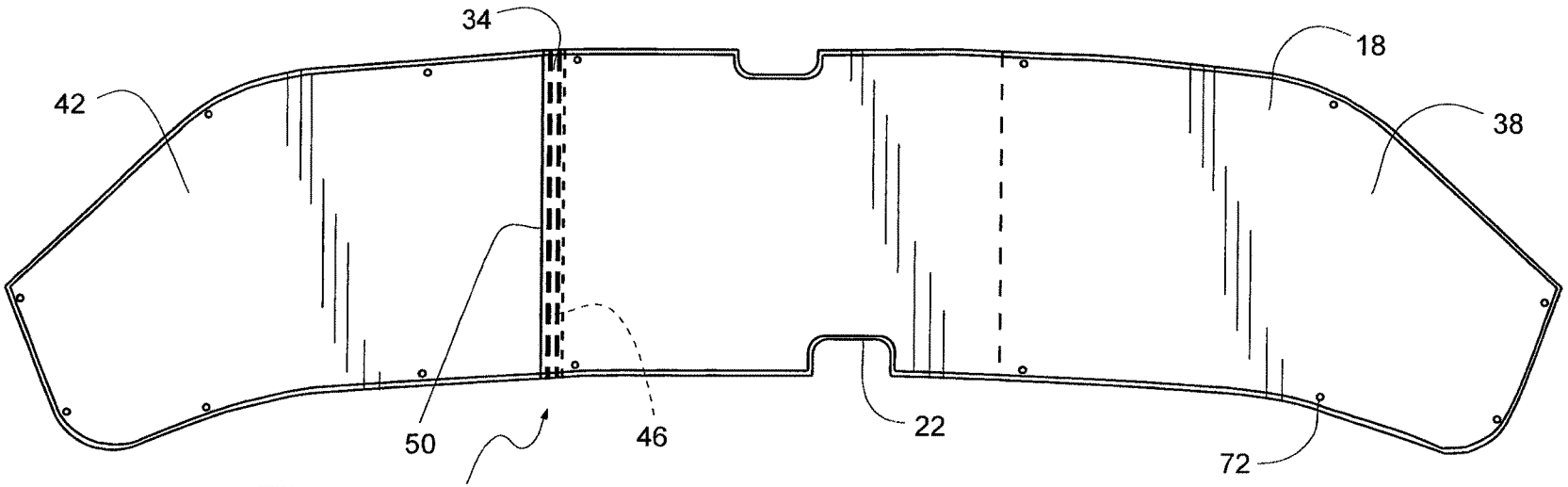
FIG. 1 is a front view of a boat windshield cover in accordance with an embodiment, the cover shown in a flat configuration and with a pair of panels in a joined and closed configuration.
Figure 2:
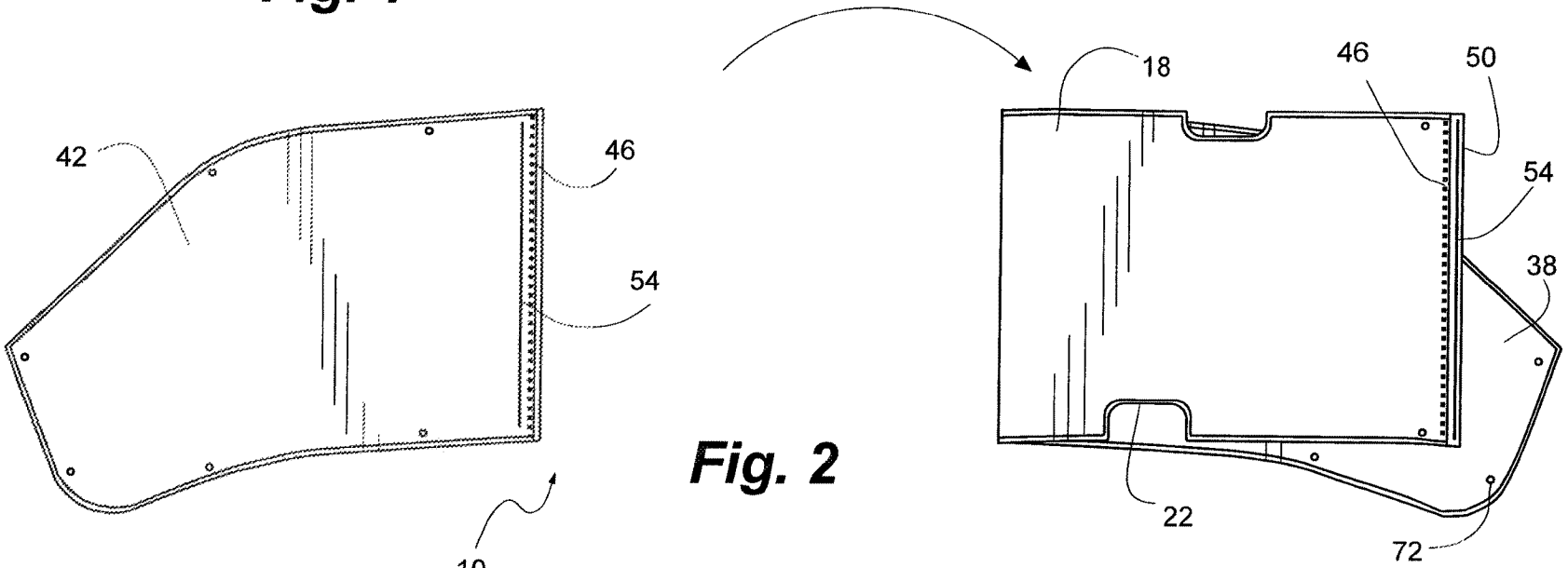
FIG. 2 is a front view of the boat windshield cover of FIG. 1, the cover shown in the flat configuration and with the pair of panels in a separated and open configuration.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

Presented is a windshield cover and method for protecting a windshield. Various vehicles, such as boats, are typically pulled on a trailer behind another vehicle or truck. The windshields are subject to damage by road debris and rocks that can be kicked-up by tires of the truck or other vehicles during travel. The invention provides a windshield cover that can be removably secured over the windshield when being pulled on a trailer to protect the windshield from damage from debris and rocks. Thus, the panel can be juxtaposed between the boat windshield and flying roadway debris and rocks. The cover can match the size and shape of the windshield to resist flapping overhangs that can repeatedly strike the vehicle and cause blemishes or other damage. In addition, the cover can be flexible to conform to a curvature of the windshield. In addition, the cover can provide a soft, cushion layer to absorb impact from rocks and debris. In addition, the cover can provide a waterproof and oil-resistant and non-absorbent material to resist weather and driving conditions.

Referring to FIGS. 1-5, a windshield cover 10 is shown in one embodiment that can be removable secured over a windshield 14 and secured to the windshield 14 or the associated vehicle. In one aspect, the windshield 14 can be a boat windshield and the vehicle can be a boat. Boat windshields can present challenges because they can have a hinged passthrough 16 or door that allows the windshield to pivot open and close, and that allows passage between the bow and the stern, or fore and aft cockpits, of the boat. In addition, even when trailered, boats can require maintenance that requires passage through the windshield. Thus, the cover 10 can be a boat windshield cover and can accommodate the passthrough, and allow functional use of the passthrough, while still remaining installed on the windshield 14.

The cover 10 can comprise a panel 18 sized and shaped to cover the windshield 14. The panel 18 can have a perimeter matching a perimeter of the windshield 14. In one aspect, the panel 18 can substantially cover the windshield 14, and the perimeter of the panel 18 can substantially match the perimeter of the windshield 14. In another aspect, the panel can cover a super majority of the windshield 14, and the perimeter of the panel 18 can match a super majority of the perimeter of the windshield 14. The super majority can be greater than 90%, greater than 94%, or greater than 98%. Thus, the panel 18 can have at least one notch 22 in the perimeter and located to correspond to structures on or around the windshield 14, such as bumpers 26, wipers, handles, latches, etc. In addition, the panel 18 can be flexible to form an arc to conform to a curvature of the windshield 14, such as along lateral sides, indicated at 30 in FIG. 3.

The panel 18 can be bifurcated off-center at a separable partition, indicated at 34, to form a pair of unequal panels, including a larger panel 38 and a smaller panel 42. A fastener 46 can be coupled between the pair of panels 38 and 42 to releasably couple the pair of panels 38 and 42 together to form the panel 18. The fastener 46 allows the pair of panels 38 and 42 to separate at a position corresponding to the hinged passthrough window portion 16 of the boat windshield 14. In one aspect, the fastener 46 can be a single elongated fastener, such as a zipper or hook-and-loop type fastener. In another aspect, the fastener can be multiple fasteners in an array along the bifurcation or partition 34, such as buttons, snaps, etc.

Figure 3:
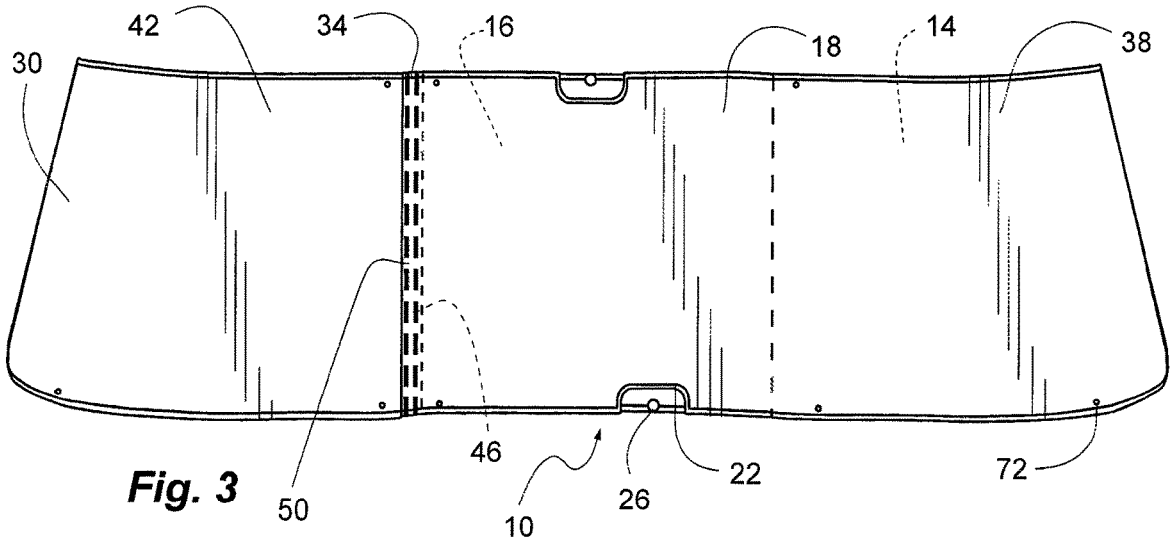
FIG. 3 is a front view of the boat windshield cover of FIG. 1 shown on a windshield of a boat and in the closed configuration.
Figure 4:
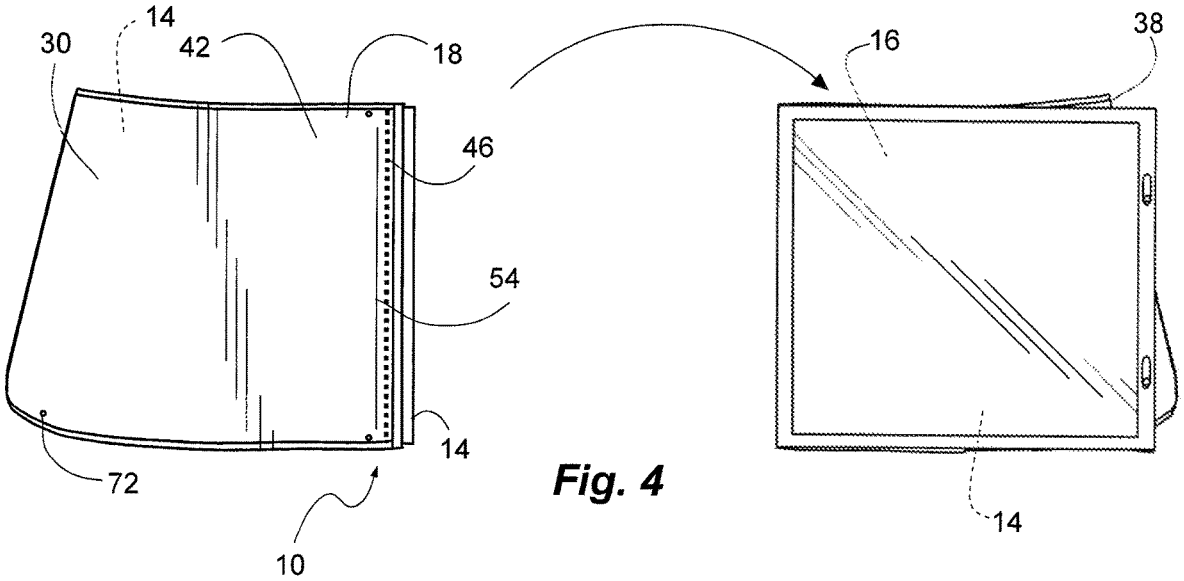
FIG. 4 is a front view of the boat windshield cover of FIG. 1 shown on the windshield of the boat and in the open configuration.
Figure 5:
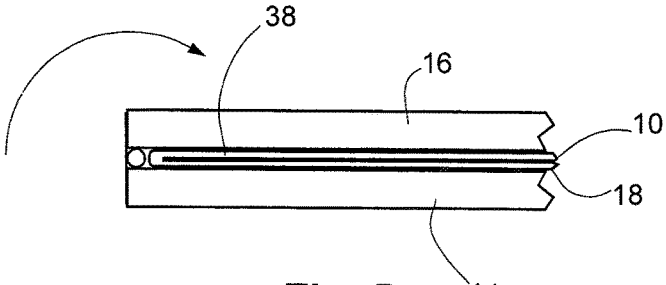
FIG. 5 is a partial end view of the boat windshield cover of FIG. 1 shown on the windshield of the boat and in the open configuration.

The panel 18 and the boat windshield 14 can have at least two configurations, including a closed configuration (FIG. 3) and an open configuration (FIGS. 4 and 5). In the closed configuration, the passthrough window portion 16 is closed with respect to the boat windshield 14, and the panel 18, and the pair of panels 38 and 42, extends across the boat windshield 14. Thus, the fastener 46 or zipper can be joined to join the pair of panels 38 and 42. In the open configuration, the passthrough window portion 16 is open and folded over the boat windshield 14. Similarly, the larger panel 38 is foldable over onto itself. In addition, the larger panel 38 can be sandwiched between the passthrough window portion 16 and the boat windshield 14, as shown in FIG. 5. As described above, the bifurcated panel 18 allows the windshield 14 to be covered, while still permitting operation of the passthrough 16.

In one aspect, a flap 50 can extend from one of pair of panels, such as the larger panel 38, over the fastener 46 or zipper when the pair of panels 38 and 42 are joined by the fastener 46 or zipper in the closed configuration. The flap 50 can protect the fastener 46 or zipper and resist fouling of the fastener 46 or zipper from debris in driving conditions. In another aspect, another fastener 54 can releasably hold the flap 50 over the fastener 46 or zipper when the pair of panels 38 and 42 are joined by the fastener 46 in the closed configuration. The another fastener 54 can resist displacement of the flap 50 away from the fastener 46 during driving conditions, such as high velocity wind. The another fastener 54 can be a hook-and-loop type fastener.

Figure 6:
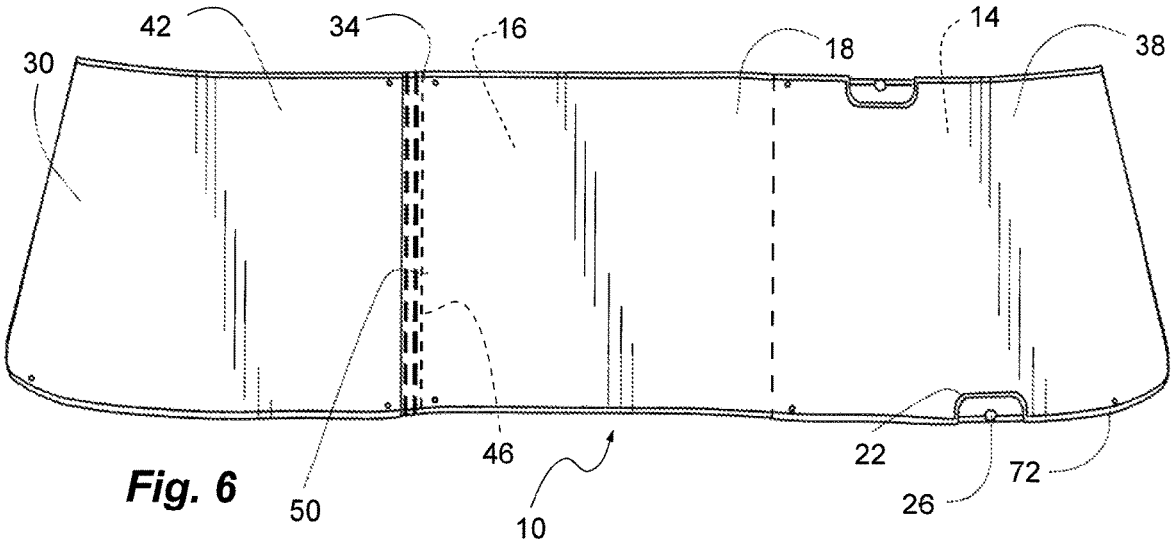
FIG. 6 is a front view of another boat windshield cover in accordance with another embodiment, the cover shown on the windshield of the boat and in the closed configuration.
Figure 7:
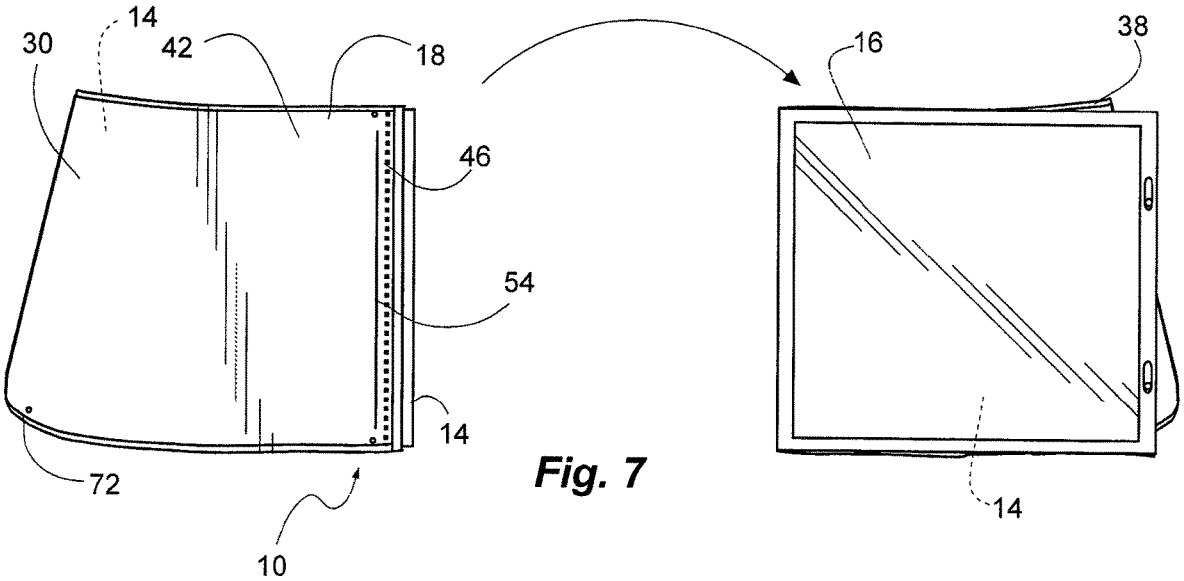
FIG. 7 is a front view of the boat windshield cover of FIG. 6 shown on the windshield of the boat and in the open configuration.

In one aspect, the notch 22 can be formed in the larger panel 38, and can be positioned over a bumper 26 carried by the passthrough 16, as shown in FIG. 3. In another aspect, the notch 22 can be positioned over a bumper 26 carried by the windshield 14, as shown in FIGS. 6 and 7.

Figure 8:
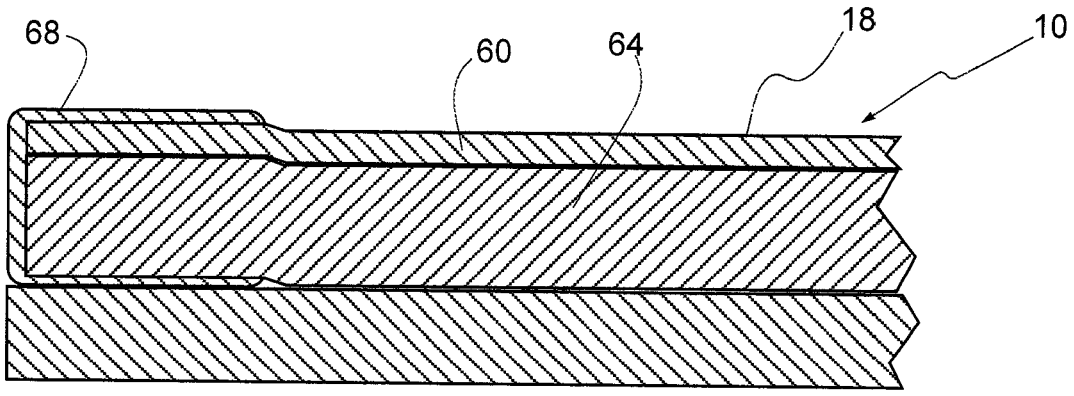
FIG. 8 is a partial cross-sectional side view of the boat windshield cover of FIG. 1 or 6 shown on the windshield of the boat.

Referring to FIG. 8, the panel 18 and the cover 10 can comprise multiple layers of different material. In one aspect, the panel 18 can comprise an outer layer 60 and an inner layer 64 affixed together to form a laminate. In one aspect, the layers 60 and 64 can be adhered together. In another aspect, the layers 60 and 64 can be sewn together. A seam can extend around a perimeter of the panel 18, and the pair of panels 38 and 42. The outer layer 60 can comprise a waterproof and oil-resistant, non-absorbent nano-material to resist moisture and oil related to travel conditions. The inner layer 64 can comprise a thicker dense foam padding that can coat a back of the outer layer 60. The inner layer 64 can contact the boat windshield 16 and can absorb impacts from rocks and debris. The thickness of the inner layer 64 of foam padding provides distance to decelerate rocks and debris, and can dissipate impact energy. In another aspect, a binding 68 can extend around and enclose an edge of the layers 60 and 64, the panel 18 and the pair of panels 38 and 42.

Figure 9:
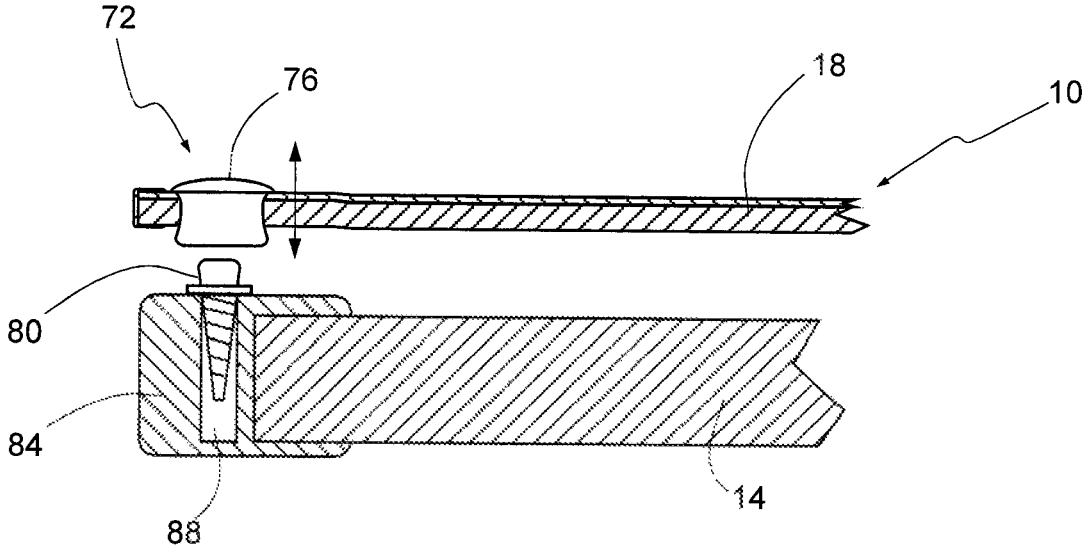
FIG. 9 is a partial cross-sectional side exploded view of the boat windshield cover of FIG. 1 or 6 shown being secured to the windshield of the boat.

Referring again to FIGS. 1-4, 6 and 7, a plurality of fasteners 72 can be arrayed around the perimeter of the panel 18 to releasably secure the panel 18 over the windshield 14 and to a perimeter of the windshield 14. In one aspect, the plurality of fasteners 72 can comprise snap fasteners, and a plurality of snap fasteners can be arrayed around the perimeter of the panel. Referring to FIG. 9, one portion or a head portion 76 of each fastener 72 can be carried by the panel 18. Another portion or insert portion 80 of each fastener 72 can be secured to a frame 84 of the boat windshield 14. In one aspect, the frame 84 can have a channel 88 that receives a screw portion of the insert portion 80 of the fastener 72. In another aspect, the screw portion can be received in a clip in the channel. The clip can be slidable in the channel and tightening the screw portion can fix the clip and the insert portion 80 in the channel 88. Securing a perimeter of the panel 18 and the cover 10 to a perimeter of the windshield 14, such as the channel 84, can hold the cover 10 and the panel 18 taut on the windshield 14. Keeping the cover 10 taut can reduce rubbing damage on the windshield 14.

In another aspect, the cover 10 and the panel 18 can be attached to the windshield 14 and/or the frame 84 thereof by clips (e.g. ⅞" or ¾"), frame rail insert clips, straps and buckles, and hook-and-loop type fasteners.

A method for protecting a windshield 14, and for using the cover 10, can comprise: securing a plurality of fasteners 72 around a perimeter of the windshield 14. The fasteners 72 can be snap fasteners with a screw portion of the insert portion 80 of the snap fastener screwed partially into a clip in the channel 88 of the frame 84 of the windshield 14.

A plurality of corresponding fasteners around a perimeter of the panel 18, such as the head portion 76 of the snap fasteners, can be fastened, such as by snapping, to corresponding fasteners, such as the insert portion 80, around the perimeter of the windshield 14. As discussed above, the insert portion 80 and clips thereof can be slid in the channel 88 of the frame 84 to achieve alignment, and then secured in place.

At least one notch 22 in a perimeter of the panel 18 can be aligned with at least one bumper 26 of the boat windshield 14.

The separable partition 34 in the panel 18 can be aligned with the passthrough window portion 16 of the boat windshield 14. The separable partition 34 can comprise a zipper releasably securing a pair of panels 38 and 42. The zipper can be un-zipped. The passthrough window portion 16 can be opened, and one of the pair of panels 38 can be folded over onto itself.

The passthrough window portion 16 can be closed. The zipper can be zipped to secure the pair of panels 38 and 42 together to form the panel 18.

Figure 10:
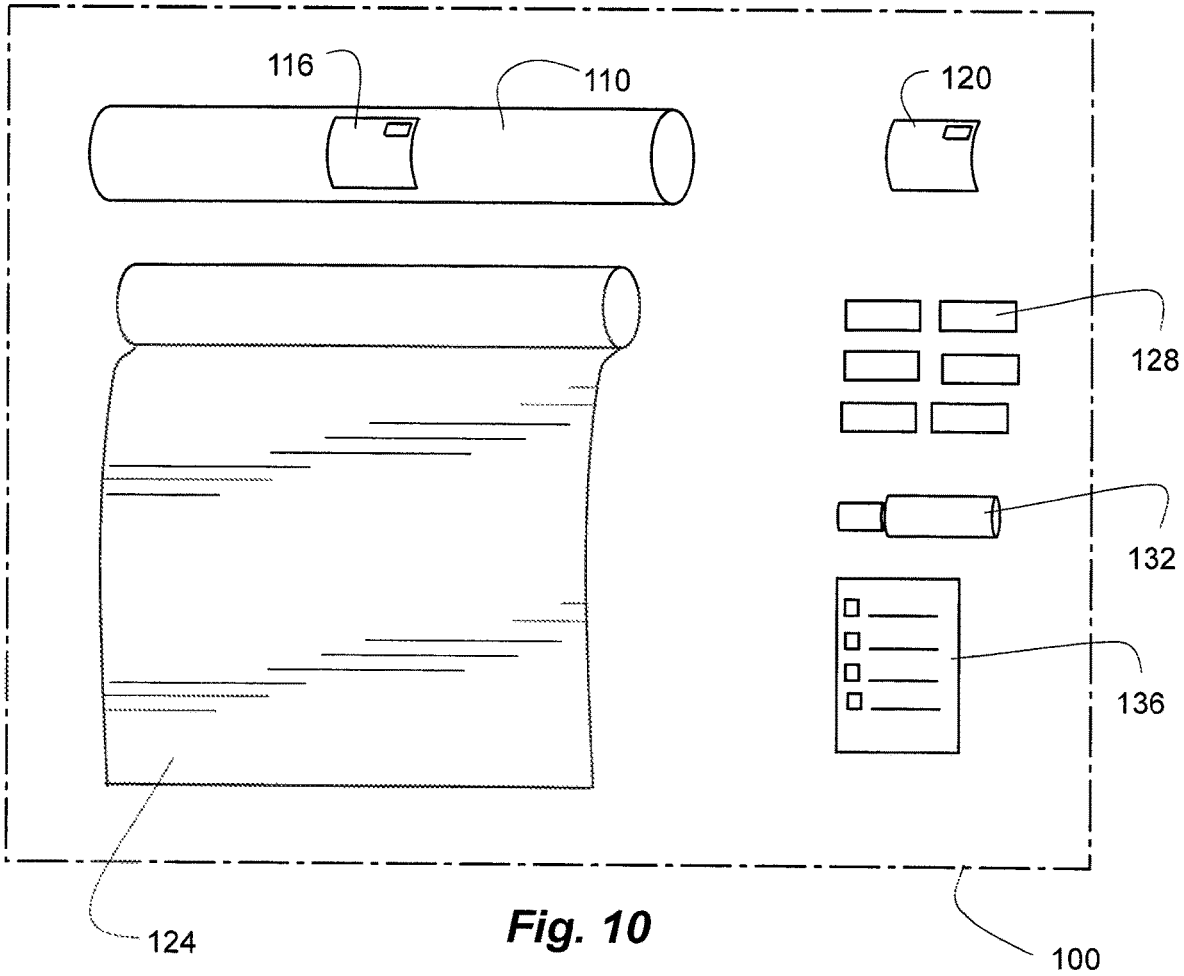
FIG. 10 is a schematic view of a kit and a method for making the boat windshield cover in accordance with an embodiment.

Referring to FIG. 10, a kit 100 is shown for providing a custom sized and shaped windshield cover 10 for a windshield 14, and for providing such a cover 10 to a vehicle location remote and distal from a manufacture location. The kit 100 can provide for creating a pattern of the boat windshield 14. The kit 100 can comprise a container 110. The container 110 can be a shipping container that can be mailed or sent to a location of a vehicle, such as a boat, remote and distant from a location of manufacture. The container 110 can have a first mailing address 116 corresponding to the location of the vehicle, and can container a return shipping label 120 with a second mailing address corresponding to the location of manufacture. The second mailing label 120 can have return postage. The kit 100 can also have a sheet of material 124 carried by the container 110, removable from the container 110, and re-insertable into the container 110. The sheet of material 124 can be sized to cover the vehicle or boat windshield 14. The sheet of material 124 can be flexible to be rolled into a role to fit into the container 110, and to conform to a curvature of the windshield 14. In one aspect, the sheet of material 124 can be at least translucent so that the windshield 14 can be viewed through the sheet of material 124. In one aspect, the sheet of material 124 can comprise a synthetic material that is lightweight, durable and breathable, and resistant to water, such as a high-density spunbound polyethylene fiber, such as Tyvek®. In one aspect, the container 110 can be a tube, and the sheet of material 124 can be provided in a roll.

The kit 100 can also contain releasable fasteners 128 carried by the container 110 for releasably securing the sheet of material 124 over the vehicle or boat windshield 14. In one aspect, the releasable fasteners 128 can comprise double sided tape. In addition, the kit 100 can also contain a writing instrument 132, such as a marker, for tracing an outline of the windshield 14, any passthrough window portion 16, locations of the frame 84 and/or braces, location of bumpers 26 or wipers, and possible location of fasteners 72 onto the sheet of material 124. Furthermore, the kit 100 can contain a list 136 of installation hardware available, such as fasteners 72 and the insert portion 80. In one aspect, the kit 100 may further contain instructions for use, such as outlined in the method described below.

Figure 11:
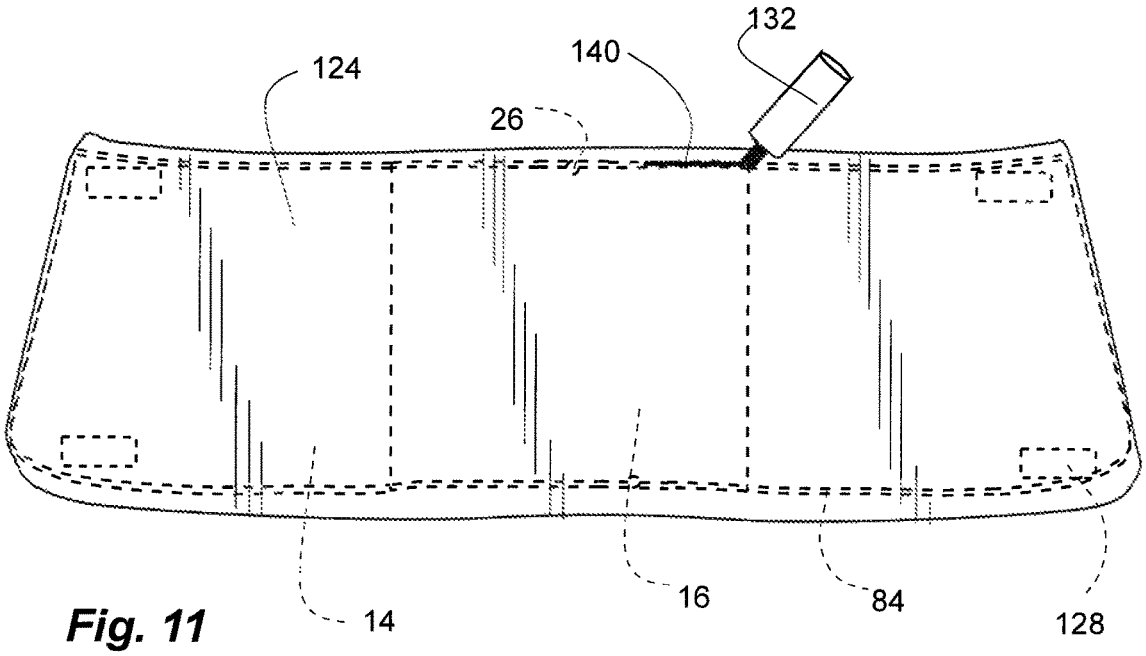
FIG. 11 is a schematic view of a method for making the boat windshield cover in accordance with an embodiment.

At the location of the vehicle or boat, the contents of the kit 100 can be removed. Referring to FIG. 11, the releasable fasteners 128 can be secured to the windshield 14 or frame 84 thereof, or to the vehicle around a perimeter of the windshield and frame. The sheet of material 124 can be unrolled and fastened over the windshield 14 with the releasable fasteners 128. An outline or pattern, indicated at 140, of the windshield 14 and/or the frame 84 thereof can be traced onto the sheet of material 124. As indicated above, the sheet of material 124 can be translucent so that the windshield 14 and/or the frame 84 can be ascertained through the sheet of material 124. In addition, the location, outline or pattern of any passthrough window portion 16 of the boat windshield 14 can be traced onto the sheet of material 124. Similarly, the location of any bumper 26, wiper, etc. can also be indicated on the sheet of material 124. In addition, the desired location for fasteners 72 can be indicated. In one aspect, the desired installation hardware can be indicated on the list 136. The sheet of material 124 can be removed from the windshield 14 and reinserted into the container 110 along with the list 136. The return shipping label 120 can be affixed to the container 110 and the container 110, the sheet of material 124, and the list 136 can be returned to the location of manufacture.

A method for providing a vehicle or boat windshield cover 10 to protect a vehicle or boat windshield 14 can comprise: providing a kit 100 as described above to the location of the vehicle; and then receiving or retrieving the kit 100 at the location of manufacture from the location of the vehicle. The method can further comprise cutting at least one layer of material, e.g. outer and inner layers 60 and 64 as described above, based on the pattern 140 of the windshield 14 traced onto the sheet of material 124; bifurcating the at least one layer of material, e.g. 60 and 64, based on the location of the passthrough window portion 16 of the boat windshield 14 traced onto the sheet of material 124 to form a pair of panels 38 and 42; and affixing a zipper 46 between the pair of panels 38 and 42. In addition, the method can further comprise securing fasteners 72 to the at least one layer of material, e.g. 60 and 64, based on the plurality of positions for fasteners indicated on the sheet of material 124.

The finished windshield cover 10 can then be sent or shipped to the location of the vehicle or boat. The installation hardware can be installed on the windshield 14 and/or the frame 84 of the vehicle or boat, and the windshield cover 10 secured by the fasteners 72. Thus, a windshield cover can be provided for various different windshield with different sizes, shapes, obstructions, etc., even remote from the manufacture.

The cover described herein can be configured for use with other vehicles with different windshields, including UTVs, tractors, heavy equipment, personal watercraft, etc.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A boat windshield cover, comprising:

a panel sized and shaped to cover a boat windshield;

the panel having a perimeter configured to match a super majority of a perimeter of the boat windshield without overhangs;

the panel being flexible and configured to conform to the boat windshield;

the panel comprising multiple layers of different material affixed together to form a laminate, the multiple layers comprising:

an outer layer of waterproof and oil-resistant, non-absorbent nano-material; and an inner layer of thicker dense foam padding coating a back of the outer layer and configured to contact the boat windshield;

a binding extending around and enclosing an edge of the outer and inner layers;

the panel being bifurcated off-center forming a pair of unequal panels including a larger panel and a smaller panel;

a fastener between the pair of panels and releasably coupling the pair of panels together to form the panel, the fastener allowing the pair of panels to separate at a position corresponding to a hinged passthrough window portion of the boat windshield; and the larger panel being foldable over onto itself and configured to be sandwiched between the passthrough window portion and the boat windshield when the passthrough window portion is in an open position.

2. The boat windshield cover of claim 1, further comprising:

a plurality of fasteners arrayed around the perimeter of the panel configured to releasably secure the panel to a perimeter of the boat windshield.

3. The boat windshield cover of claim 2, wherein the plurality of fasteners further comprises:

a plurality of snap fasteners each comprising a head portion carried by the panel and an insert portion configured to be secured to a frame of the boat windshield.

4. The boat windshield cover of claim 1, wherein the fastener further comprises:

a zipper between the pair of panels and releasably coupling the pair of panels together to form the panel; and a flap extending from one of pair of panels over the zipper when the pair of panels are joined by the zipper.

5. The boat windshield cover of claim 4, further comprising:

a hook-and-loop fastener releasably holding the flap over the zipper when the pair of panels are joined by the zipper.

6. The boat windshield cover of claim 1, further comprising:

a flap extending from one of pair of panels over the fastener when the pair of panels are joined by the fastener.

7. The boat windshield cover of claim 6, further comprising:

another fastener releasably holding the flap over the fastener when the pair of panels are joined by the fastener.

8. The boat windshield cover of claim 1, further comprising:

at least one notch in the perimeter of the panel configured to correspond to a bumper of the passthrough window portion of the boat windshield.

9. The boat windshield cover of claim 1, further in combination with a boat windshield, the combination comprising:

the panel being releasably coupled to a perimeter of the boat windshield; and the panel and the boat windshield having at least two configurations comprising:

a closed configuration in which the passthrough window portion is closed with respect to the boat windshield and the panel extends across the boat windshield; and the open configuration in which the passthrough window portion is open and folded over the boat windshield and the larger panel is foldable over onto itself and sandwiched between the passthrough window portion and the boat windshield.

10. The combination of claim 9, further comprising:

a plurality of fasteners arrayed around the perimeter of the panel;

one portion of each fastener carried by the panel; and another portion of each fastener secured to a frame of the boat windshield.

11. A towable vehicle windshield cover configured to be removably coupled over a towable vehicle windshield, the cover comprising:

a panel having a perimeter matching a super majority of a perimeter of the towable vehicle windshield, the panel being flexible to conform to the towable vehicle windshield;

the panel having an outer layer of waterproof and oil-resistant, non-absorbent nano-material;

the panel having an inner layer of thicker dense foam padding coating a back of the outer layer and configured to contact the boat windshield;

the panel and the towable vehicle windshield having at least two configurations comprising:

a closed configuration in which the panel is configured to extend across the towable vehicle windshield; and an open configuration in which the panel is foldable over onto itself and configured to be sandwiched between a window portion and the towable vehicle windshield.

12. The towable vehicle windshield cover of claim 11, further comprising:

a plurality of snap fasteners arrayed around the perimeter of the panel configured to releasably secure the panel to the perimeter of the towable vehicle windshield;

one portion of each snap fastener carried by the panel; and another portion of each snap fastener secured to a frame of the towable vehicle windshield.

13. A method for protecting a boat windshield, comprising:

securing a plurality of snap fasteners around a perimeter of the boat windshield;

snapping a plurality of corresponding snap fasteners around a perimeter of a panel of a boat windshield cover to corresponding snap fasteners around the perimeter of the boat windshield;

aligning at least one notch in a perimeter of the panel with at least one bumper of the boat windshield;

aligning a separable partition in the panel with a passthrough window portion of the boat windshield, the separable partition comprising a zipper releasably securing a pair of panels;

un-zipping the zipper;

opening the passthrough window portion and folding one of the pair of panels over onto itself;

closing the passthrough window portion; and zipping the zipper securing the pair of panels together to form the panel; and wherein the boat windshield cover comprises:

the perimeter of the panel matching a super majority of a perimeter of the boat windshield without overhangs;

the panel comprising multiple layers of different material affixed together to form a laminate, the multiple layers comprising:

an outer layer of waterproof and oil-resistant, non-absorbent nano-material; and an inner layer of thicker dense foam padding coating a back of the outer layer and configured to contact the boat windshield; and a binding extending around and enclosing an edge of the outer and inner layers.

14. A method for providing a towable vehicle windshield cover to protect a towable vehicle windshield, comprising:

providing a kit for creating a pattern of the towable vehicle windshield, the kit comprising:

a container;

a sheet of material carried by the container and sized to cover the towable vehicle windshield; and releasable fasteners carried by the container for releasably securing the sheet of material over the towable vehicle windshield;

receiving the kit with the towable vehicle windshield pattern traced onto the sheet of material; and cutting at least one layer of material based on the pattern traced onto the sheet of material.

15. The method of claim 14, wherein the sheet of material is at least translucent.

16. The method of claim 14, wherein receiving the kit further comprises:

receiving the kit with a plurality of positions for fasteners indicated on the sheet of material; and further comprising:

securing fasteners to the at least one layer of material based on the plurality of positions for fasteners indicated on the sheet of material.

17. The towable vehicle windshield cover of claim 11, wherein the towable vehicle windshield is a boat windshield and wherein the towable vehicle windshield cover is a boat windshield cover, the boat windshield cover further comprising:

the panel being bifurcated off-center forming a pair of unequal panels including a larger panel and a smaller panel;

a zipper between the pair of panels and releasably coupling the pair of panels together to form the panel, the zipper allowing the pair of panels to separate at a hinged passthrough window portion of the boat windshield and with the larger panel foldable over onto itself and sandwiched between the passthrough window portion and the boat windshield;

a flap extending from one of pair of panels over the zipper; and at least one notch in the perimeter of the panel configured to correspond to a bumper of the passthrough window portion of the boat windshield.

18. The towable vehicle windshield cover of claim 11, further comprising:

a binding extending around and enclosing an edge of the outer and inner layers.

19. The boat windshield cover of claim 1, in combination with the boat window, the boat windshield cover further comprising:

the inner layer of thicker dense foam padding contacting the boat windshield.

* * * * *